US005533878A

United States Patent [19]

Iwata

[11] Patent Number: 5,533,878

[45] Date of Patent: Jul. 9, 1996

[54] SQUEEZE TYPE PUMP

[75] Inventor: Noboru Iwata, Hashima, Japan

[73] Assignee: Daiichi Techno Co., Ltd., Gifu-Ken, Japan

[21] Appl. No.: 407,481

[22] Filed: Mar. 2, 1995

[30] Foreign Application Priority Data

May 11, 1994 [JP] Japan ..... 6-097707

[51] Int. Cl.[6] ..... F04B 43/08

[52] U.S. Cl. ..... 417/477.3; 417/477.9

[58] Field of Search ..... 417/474, 476, 417/477.1, 477.3, 477.9

[56] References Cited

U.S. PATENT DOCUMENTS

| | | | |
|---|---|---|---|
| 562,903 | 6/1896 | Messmer | 137/565 |
| 2,831,437 | 4/1958 | Cromwell et al. | 417/477.5 |
| 2,917,002 | 12/1959 | Mascaro | 417/477.5 |
| 3,140,666 | 7/1964 | Currie | 417/477.11 |
| 3,421,447 | 1/1969 | Jackson et al. | 417/477.6 |
| 3,567,345 | 3/1971 | Ballentine | 417/477.3 |
| 3,784,323 | 1/1974 | Sausse | 417/53 |
| 3,875,970 | 4/1975 | Fitter | 417/477.3 |
| 4,492,538 | 1/1985 | Iwata | 417/477 |
| 4,518,327 | 5/1985 | Mackman | 417/477.3 |
| 4,632,646 | 12/1986 | Iwata | 417/477 |
| 4,730,993 | 3/1988 | Iwata | 417/477 |
| 4,906,168 | 3/1990 | Thompson | 417/476 |
| 4,954,055 | 9/1990 | Raible et al. | 417/474 |
| 5,024,586 | 6/1991 | Meiri | 417/477.9 |

*Primary Examiner*—Peter Korytnyk
*Attorney, Agent, or Firm*—Sheridan Ross & McIntosh

[57] ABSTRACT

A squeeze pump has an elastic tube disposed between an inlet and an outlet of a cylindrical drum and extends along an inner peripheral surface of the drum. A pair of pressing rollers spaced by 180 degrees are arranged to press the tube. The tube is deformed into a flat shape with two bent portions to transfer a slurry within the tube. The tube has a large diameter in the inlet and a small diameter in the outlet. Each pressing roller has a large diameter formed at the middle and a small diameter at both ends. A support member extends along the inner peripheral surface of drum to support at least one of the bent portions of tube when the tube is pressed by the pressing roller.

15 Claims, 9 Drawing Sheets

SQUEEZE TYPE PUMP

BACKGROUND OF THE INVENTION

1. Field of the Invention

This invention relates to a squeeze type pump for transferring slurry such as freshly mixed concrete. More particularly, the invention relates to a structure for improving the durability of a tube forming a passageway for slurry and also preventing pulsation resulting from the squeezing of slurry.

2. Description of the Related Art

Generally, as shown in FIG. 12, a squeeze type pump 70 for transferring slurry such as freshly mixed concrete is mounted on a vehicle 71. The squeeze type pump 70 is driven by a drive source 72 such as a motor. As the pump 70 is driven, the slurry is introduced into a hopper 73, transferred through a transfer tube 74, and discharged from a discharge port 75 of the distal end of the transfer tube 74 to a work location such as a building, etc. A boom 76 is also mounted to the vehicle 71. As shown by the broken chain line in FIG. 12, as the boom 76 is expanded, the transfer tube 74 is extended upward. Thus, the slurry that is transferred through the transfer tube 74 can be supplied to a higher location.

In the squeeze type pump described above, an elastic tube 52 is disposed along the inner circumferential surface of a drum 53, as shown in FIG. 11. A pair of pressing rollers 50 and 51 are rotated on a center of axis α of the drum 53 in the direction indicated by the arrow, while pressing the tube 52 against the inner circumferential surface of the drum 53. Consequently, the slurry in the tube 52 is squeezed and pumped.

When the leading roller 50 completes the squeeze operation and starts moving away from the tube 52, a chamber 61 of the tube 52 between both rollers 50 and 51 is communicated with a chamber 60 on the downstream side of the leading roller 50. In the initial stage of this movement, the roller 50 is not yet fully separated from the tube 52 and a narrow gap is formed inside the tube 52 at a position where the roller 50 contacts the tube 52.

The internal pressure of the chamber 60 is higher than that of the chamber 61 between the rollers 50 and 51. For this reason, when the above-described gap is formed, the slurry in the chamber 60 will abruptly flow backward through the gap into the chamber 61. This back flow causes pulsation of the slurry which severely wears the inner surface of the tube 52. In addition, the capacity of the pump is reduced because of the back flow of the slurry.

In order to overcome the above-described problem, there has been proposed a squeeze type pump disclosed in Japanese Unexamined Patent Publication No. 52-149605. See FIG. 8. The tube 52A of this pump is tapered. The cross-sectional area of the passageway is large at the upstream side and small at the downstream side.

In this pump, when both rollers 50 and 51 are moved from a position on line 3—3 to a position on line 4—4, the volume of a chamber 61A located between the rollers 50 and 51 is gradually reduced and thus the pressure in the chamber 61A is gradually increased. Therefore, when the leading roller 50 is moved away from a tube 52A and the chamber 61A is communicated with a chamber 60A, there will be little or no back flow of the slurry in the chamber 60A toward the chamber 61A because of the relatively high pressure in the chamber 61A. As a consequence, pulsation hardly occurs, pump operation is relatively smooth, and wear on the inner surface of the tube 52A is reduced.

As shown in FIG. 9, there has also been proposed a pump in which the diameter of the central portion of each of rollers 50A and 51A is made larger than that of the end portions. In such a pump, when a tube 52 is deformed into a flat shape, the pressing force acting on the laterally opposite curved portions 56 of the tube 52 is relatively lower. As a result, the fatigue on the curved portion 56 is reduced and the durability of the tube 52 is improved.

However, in the above-described pump, when the tube 52 is deformed into a flat shape between the inner circumferential surface of the drum 53 and the rollers 50A, 51A, it is possible that the tube 52 may be dislocated right or left because of a difference in densities of the slurry in the tube 52. For example, if the tube 52 is dislocated left as shown by the broken line in FIG. 9, a gap 55 will occur in the inside of the curved portion 56 of the tube 52. In such case, when the rollers 50A and 51A are located at positions corresponding to the positions on line 5—5 of FIG. 8 where the chamber 61A is not yet completely formed, the relatively high-pressure slurry in the chamber 60A flows backward through the gap 55. As a result, the inner surface of the tube 52 is severely worn and at the same time the capacity of the pump is reduced.

In U.S. Pat. No. 4,730,993, a squeeze type pump is disclosed in which the opposite sides of a tube 52 are pressed by a pair of parallel spaced rollers 57, as shown in FIG. 10. When a tapered tube such as that shown in FIG. 8 is used in this pump, a central portion 65 of an upstream section of the tube 52 is pressed by the central portions 64 of the lower rollers 57. Since the tube 52 is centrally pressed, no gap is formed in the pressed portion 54 of the tube 52.

However, in the downstream stage of the squeeze by a pair of upper rollers 57 shown in FIG. 10, the central portion 65 of the tube 52 is outwardly spaced from the center 64 of the rollers 57. This dislocation of the tube 52 in the downstream stage of the squeeze is due to the pressing of the tube 52 toward the drum 53 when the rollers 57 are rotated. For this reason, the gap 55 is produced in the outward portion of the pressed portion 54 of the tube 52. As a result, back flow of the slurry, wear on the inner surface of the tube 52, and a reduction in the pump capacity occurs. In addition, the durability of the tube 52 is reduced since a great compression force is applied to the inner curved portion of the tube 52 opposite the gap 55 by the large-diameter portions of the rollers 57.

SUMMARY OF THE INVENTION

Accordingly, it is a primary objective of the present invention to provide a squeeze type pump which is capable of keeping a use life of a tube for a long period of time.

It is another objective of the present invention to provide a squeeze type pump capable of stable operation.

To achieve the above objectives, an improvement of the squeeze pump is proposed. The squeeze pump has an elastic tube which is disposed between an inlet and an outlet of a cylindrical drum and extends along an inner peripheral surface of the drum. The pump further has a plurality of pressing rollers spaced by a predetermined angle and rotatable about an axis of said drum. The pressing rollers press the tube, whereby said tube is deformed into a flat shape with two bent portions to transfer a slurry within the tube. The tube includes a large diameter passageway disposed in the inlet, a small diameter passageway disposed in the outlet and a tapered passageway continuously extending from the large diameter passageway to the small diameter passageway.

These three passageways have a common center. Each pressing roller has a roller axis extending along the entire length of the pressing roller. The pressing roller has a large diameter portion formed at the middle of the roller axis, two small diameter portions respectively formed at ends of the roller axis and two tapered portions respectively extending from the large diameter portion to the small diameter portions. The pump has a support member extending along the inner peripheral surface of the drum. The support member supports at least one of the bent portions of the tube when the tube is pressed by the pressing roller.

BRIEF DESCRIPTION OF THE DRAWINGS

The features of the present invention that are believed to be novel are set forth with particularity in the appended claims.

The invention, together with objects and advantages thereof, may best be understood by reference to the following description of the presently preferred embodiments together with the accompanying drawings in which.

DETAILED DESCRIPTION OF THE PREFERRED EMBODIMENTS

A squeeze type pump according to a first embodiment of the present invention will now be described with reference to FIGS. 1 to 5.

Figure 2:
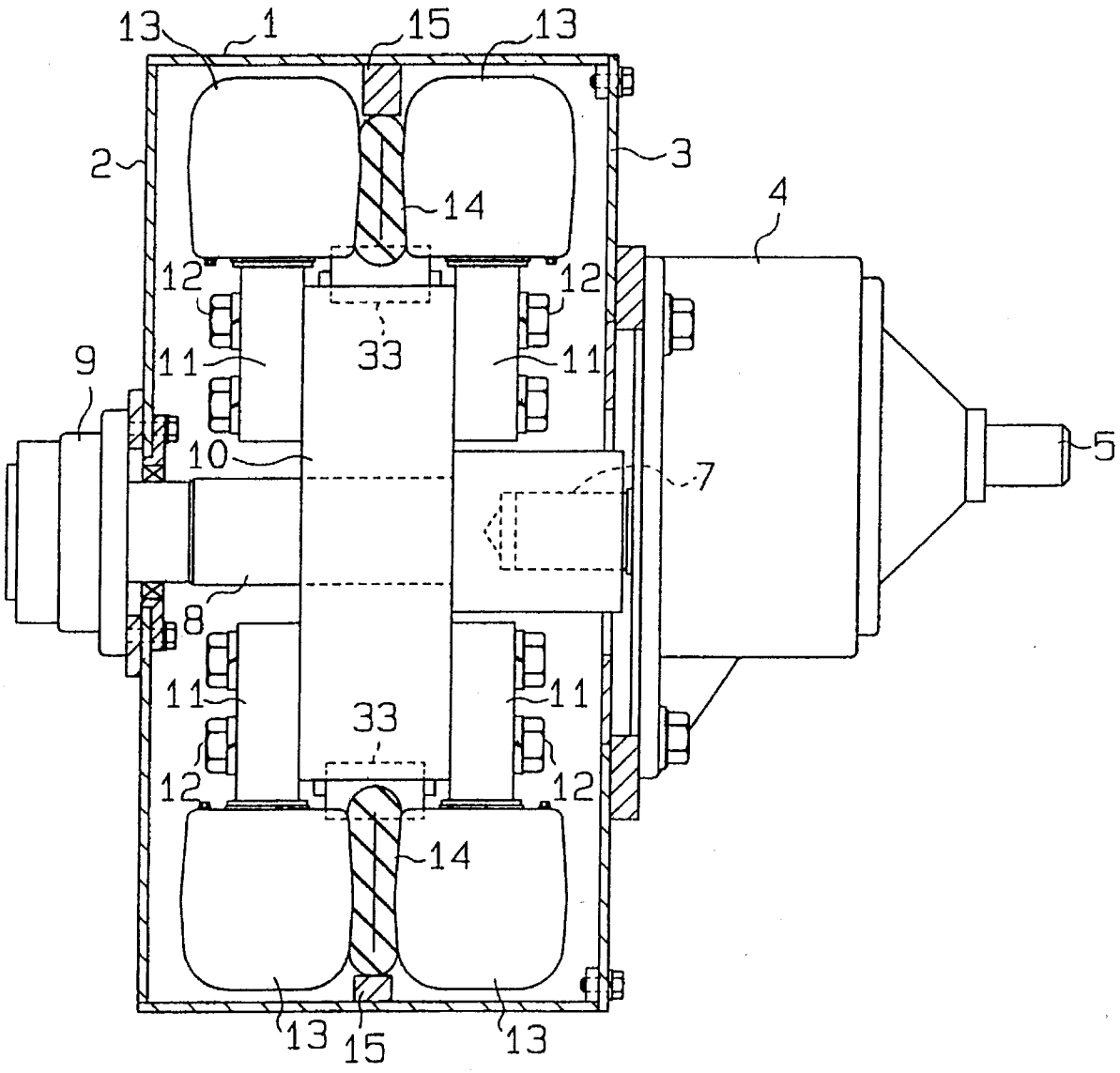
FIG. 2 is a cross-sectional view taken along the line 2—2 in FIG. 1.

As shown in FIG. 2, a first disk 2 is fixed to the left side portion of a cylindrical drum 1 and a second disk 3 is bolted to the right side portion of the drum 1.

A speed reducer 4 is attached to the second disk 3 and has an input shaft 5 fixed to a pulley (not shown). An output shaft 7 of the reducer 4 extends along the center axis line of the drum 1 and projects into the interior of the drum 1. This output shaft 7 is connected to a rotary shaft 8 which is supported at the central portion of the first disk 2 with a bearing 9.

A rotational block 10 is fixedly mounted on the shaft 8. Two pairs of support shafts 11 are bolted to the block 10 so that their axes are radially oriented with respect to the rotary shaft 8. The two pairs of the support shafts 11 are spaced 180 degrees apart. The support shafts 11 of each pair are disposed on the opposite surfaces of the rotational block 10 so that the block 10 is interposed between the shafts of an associated pair. Each support shaft 11 has a pressing roller 13 rotatably mounted on the distal end thereof. The axis of each pressing roller 13 is radially oriented with respect to the rotary shaft 8.

An elastic rubber tube 14 is fed into the drum 1 through an inlet 1*a* of the drum 1, and extends along the inner circumferential surface of the drum 1 in the form of a semicircular arc, and is pulled out of the drum 1 through an outlet 1*b* of the drum 1. The tube 14 thus disposed is pressed at both sides thereof by the two pairs of rollers 13 and deformed into a flat shape. The end portions of tube 14 disposed in the inlet 1*a* and in the outlet 1*b* are fixed to the drum 1 by fixing means (not shown).

Figure 3:
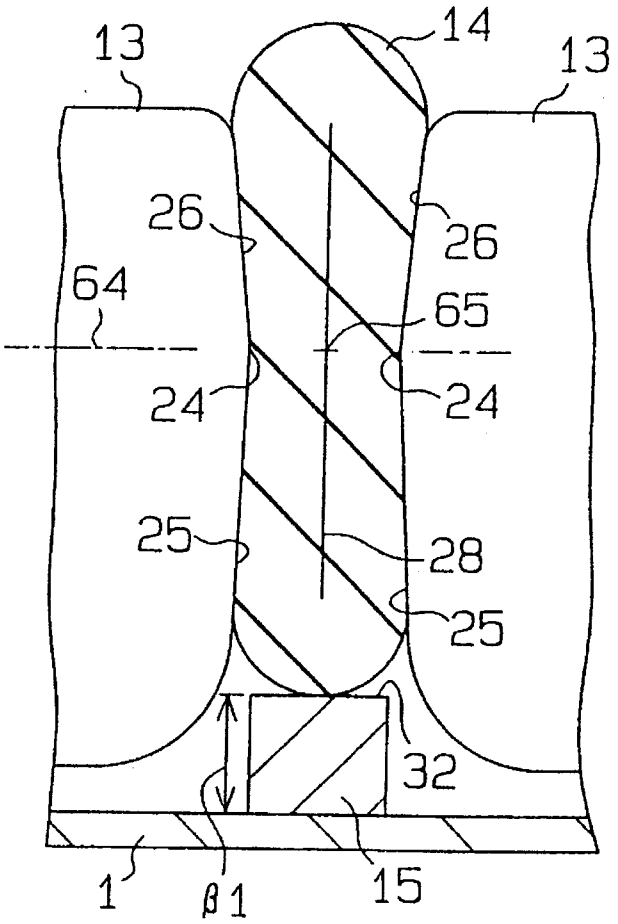
FIG. 3 is a partial enlarged cross-sectional view showing the pressed state of a tube by rollers in a squeeze starting position.
Figure 4:
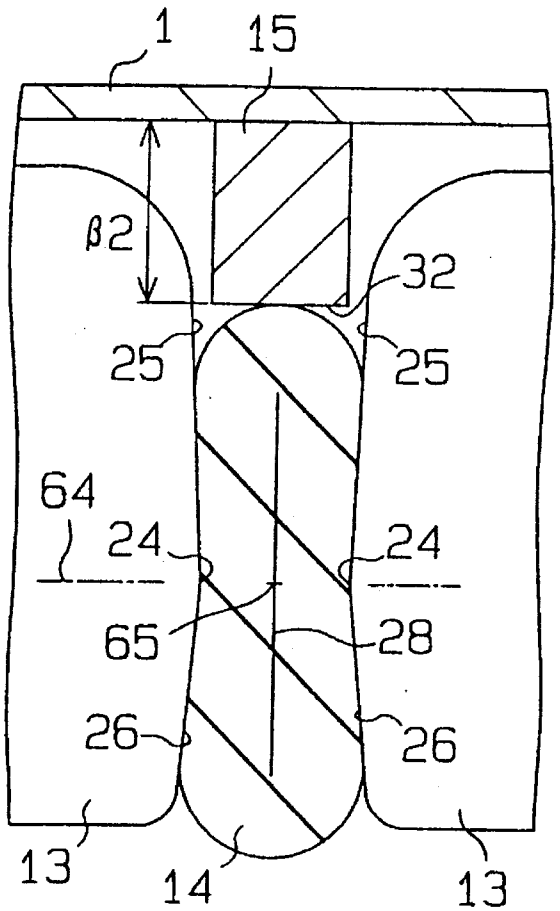
FIG. 4 is a partial enlarged cross-sectional view showing the pressed state of a tube by rollers in a squeeze completing position.

A semicircular annular protrusion or support member 15 is fixed to the inner circumferential surface of the drum 1 by welding or the like. As shown in FIGS. 3 and 4, the inner circumferential face of this support member 15 functions as a holding face 32. The holding face 32 contacts the curved portion of the outer side of the tube 14 when the tube 14 is pressed into a flat shape by the rollers 13 and prevents the tube 14 from being moved excessively in an outward direction toward the inner circumferential surface of the drum 1.

Figure 1:
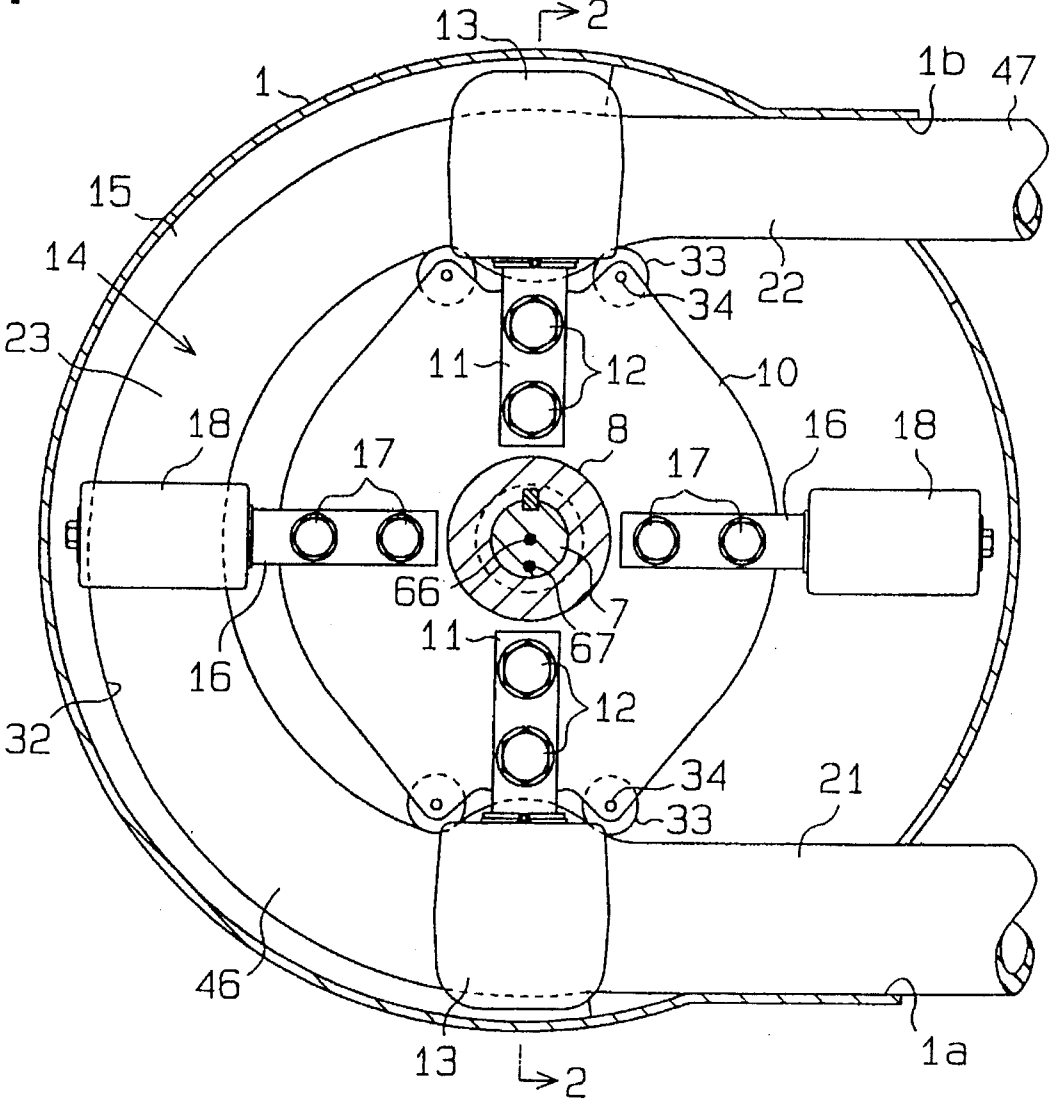
FIG. 1 is a cross-sectional side elevation view of a squeeze type pump showing a first embodiment of the present invention.

As shown in FIG. 1, two pairs of support shafts 16 are bolted to the rotational block 10 with bolts 17 so that they are radially oriented with respect to the rotary shaft 8. The support shafts 16 of each pair are disposed on the opposite surfaces of the rotational block 10 are spaced 180 degrees apart. Each support shaft 16 is spaced 90 degrees from the above described support shafts 11. Each support shaft 16 has a holding roller 18 rotatably mounted on its distal end such that the axis of each holding roller 18 is radially oriented with respect to the rotary shaft 8. The holding rollers 18 of each pair move on the outer surface of the tube 14. The holding rollers 18 serve to hold the tube 14 and keep it from shifting position.

Figure 5:
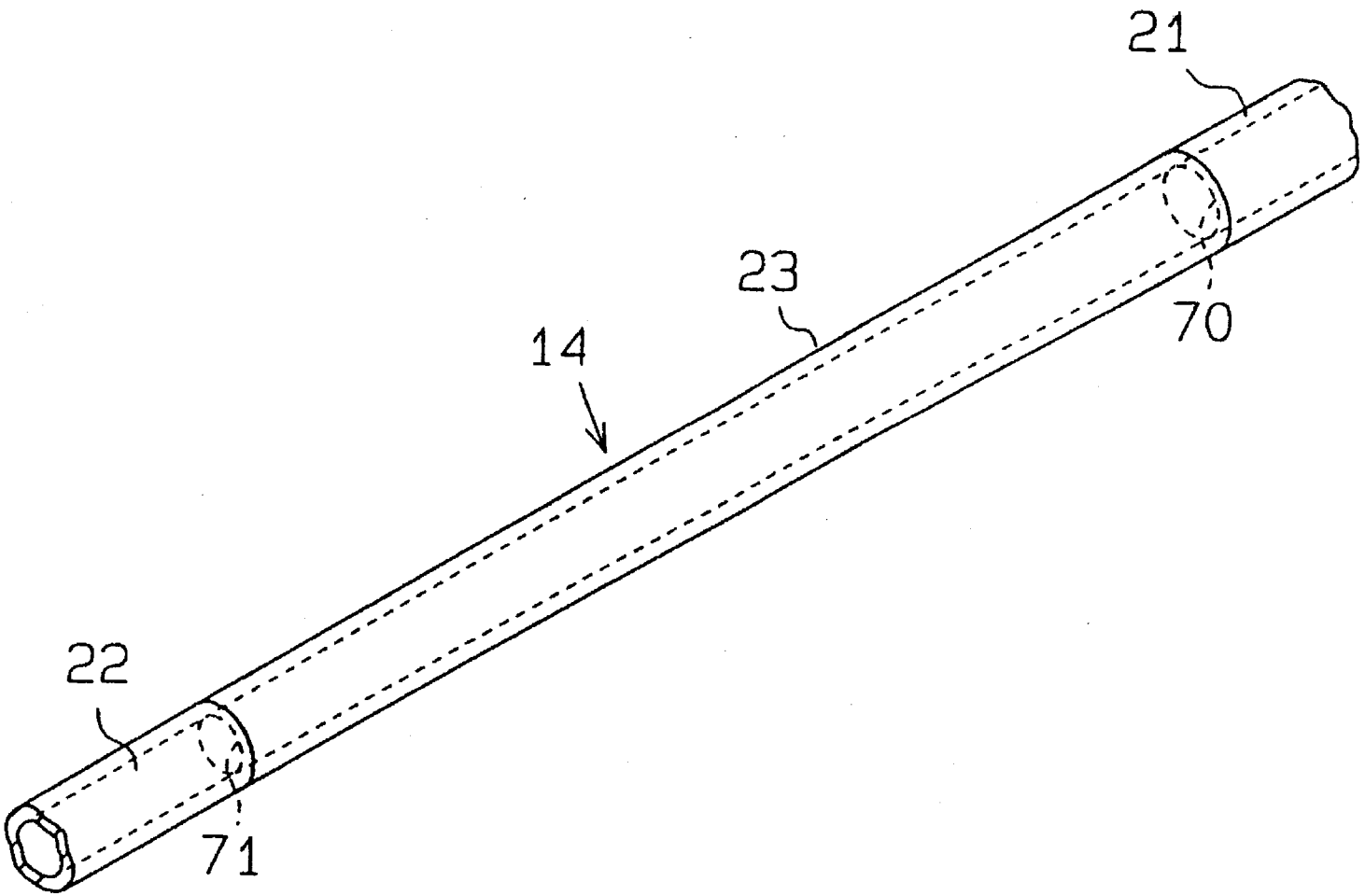
FIG. 5 is a perspective view of an elastic tube with portions broken away.

As shown in FIG. 5, the tube 14 consists of a large outer-diameter portion 21, a relatively small outer-diameter portion 22, and a taper portion 23 extending between the large diameter portion 21 and the small diameter portion 22. The large diameter portion 21 is disposed in a position corresponding to the inlet la of the drum 1, and the relatively small diameter portion 22 is disposed in a position corresponding to the outlet 1*b* of the drum 1. As a consequence, the cross sectional area of the passageway of the taper portion 23 is gradually reduced from the inlet 1*a* of the drum 1 toward the outlet 1*b*, in other words, from the squeeze starting side toward the squeeze completing side.

As shown in FIGS. 3 and 4, the pressing roller 13 consists of a large diameter portion 24 formed at the central portion thereof, and a pair of taper portions 25 and 26 extending from either side of the large diameter portion 24. The taper portions 25 and 26 are gradually reduced in diameter toward the opposite ends of the roller 13 and form a pair of small diameter portions. Therefore, the pressing force of the roller 13 to the tube 14 is gradually reduced from the central portion of the tube 14 toward the opposite sides. As a consequence, a reduced pressing force acts on the upper and lower curved portions of the tube 14. As the pressing rollers travel radially within the drum 1, the large diameter portion 24 of the pressing roller 13 travels along a first predetermined path to press the center of the passageway of the tube 14. Likewise, the small diameter portions of the passing roller 13 travel along a second predetermined path to press the upper and lower curved portions of the tube 14.

As shown in FIG. 1, an axis of rotation 66 of the roller 13 is identical with the center axis of the rotary shaft 8. A center axis 67 of the semicircular arc of the holding surface 32 is in a location displaced from the axis of rotation 66 by a predetermined distance. For this reason, the height β1 of the holding surface 32 at the squeeze starting position is smaller than the height β2 of the holding surface 32 at the squeeze completing position, as shown in FIGS. 3 and 4.

With this construction, as shown in FIGS. 3 and 4, the central portion 65 of the tube 14 is pressed at all times by the large diameter portions 24 of the rollers 13. As shown in FIG. 1, in both the restoration state and the flat state, the tube 14 is contacted on its outer circumferential edge by the holding surface 32 of the protrusion 15.

As shown in FIGS. 1 and 2, in the vicinity of each of the rollers 13, restoration rollers 33 are rotatably supported on the rotational block 10 by means of pins 34. The restoration rollers 33 are spaced from the inner circumferential surface of the drum and press on the inner circumferential surface of the tube 14 to help restore the tube 14 to its original cylindrical shape.

The operation of the squeeze type pump constructed as described above will hereinafter be described.

Referring to FIG. 2, when the input shaft 5 is rotated by a motor (not shown), the output shaft 7 and the rotary shaft 8 is rotated through the reducer 4. Then, the block rotational 10, the support shafts 11, and the pressing rollers 13, together with the rotary shaft 8, are rotated as a single body. Therefore, the rollers 13 are rotated along the inner circumferential surface of the drum 1, the tube 14 is deformed into a flat shape, and the slurry in the tube 14 is pumped.

When the tube 14 is deformed into a flat shape, the central portion 65 of the tube 14 in the flat state is pressed at all times by the large diameter portions 24 of the rollers 13, in the other words, the central portions 64 of the rollers 13, as shown in FIGS. 3 and 4.

For example, in FIG. 2, the tube 14 is deformed into a flat shape by clamping the opposite sides of the tube 14 at the squeeze starting position by a pair of lower rollers 13. In this state, as clearly shown in FIG. 3, the curved portion of the outer circumferential surface of the tube 14 is received by the holding surface 32 of the protrusion 15 so as not to be moved toward the inner circumferential surface of the drum 1. The central portion 65 of the tube 14 is therefore pressed at all times by the large diameter portions 24 of the rollers 13.

Referring to FIG. 2, the tube 14 is deformed into a flat shape at the squeeze completing position by a pair of upper rollers 13. In this state, as clearly shown in FIG. 4, the curved portion of the outer circumferential surface of the tube 14 is received by the holding surface 32 such that movement of the tube 14 toward the inner circumferential surface of the drum 1 is prevented. The central portion 65 of the tube 14 is therefore pressed at all times by the large diameter portions 24 of the rollers 13.

Therefore, no gap is allowed to form in the pressed portion 28 of the tube 14 before the squeeze operation is completed. As a consequence, a back flow of the slurry in the tube 14, wear on the inner circumferential surface of the tube 14 resulting from that back flow, and a reduction in the pump capacity can be effectively prevented.

As shown in FIGS. 3 and 4, the portions near the curved sides of the tube 14 are always pressed by the taper portions 26 and 25. For this reason, a reduced pressing force is exerted on the curved portions of the tube 14. Consequently, the fatigue on the curved portions is reduced and the durability of the tube 14 is improved.

As the result of experiments on the conventional taper tube 14, the present inventors obtained the following findings. A ratio of the cross-sectional area of the passageway 71 of the small diameter portion 22 of the tube 14 to the cross-sectional area of the passageway 70 of the large diameter portion 21 was made 30 to 40%. In this tube 14, when the leading roller 13 has completed its squeeze operation, the pressure in the chamber 46 of the tube 14 between both rollers 13 and the pressure in the chamber 47 on the downstream side of the leading roller 13 became almost the same. If the ratio of the cross-sectional area of the small outer-diameter portion 22 to the cross-sectional area of the large outer-diameter portion 21 is set to about 30% when slurry is relatively soft, and if this ratio is set to about 40% when slurry is relatively hard, better results were obtained. Therefore, if the ratio of the cross-sectional areas appropriately set according to the hardness of slurry, the back flow of the slurry in the tube 14 can be reliably prevented when the leading roller 13 is moved away from the tube 14. Therefore, pulsation, wear on the inner circumferential surface of the tube 14, and a reduction in the pump capacity, which results from back flow of the slurry, can be prevented more reliably.

A second embodiment of the present invention will next be described with reference to FIGS. 6 and 7. Many of the parts of the second embodiment are identical to the corresponding parts of the first embodiment. Thus, the same reference numerals will be applied to the identical parts.

Figure 6:
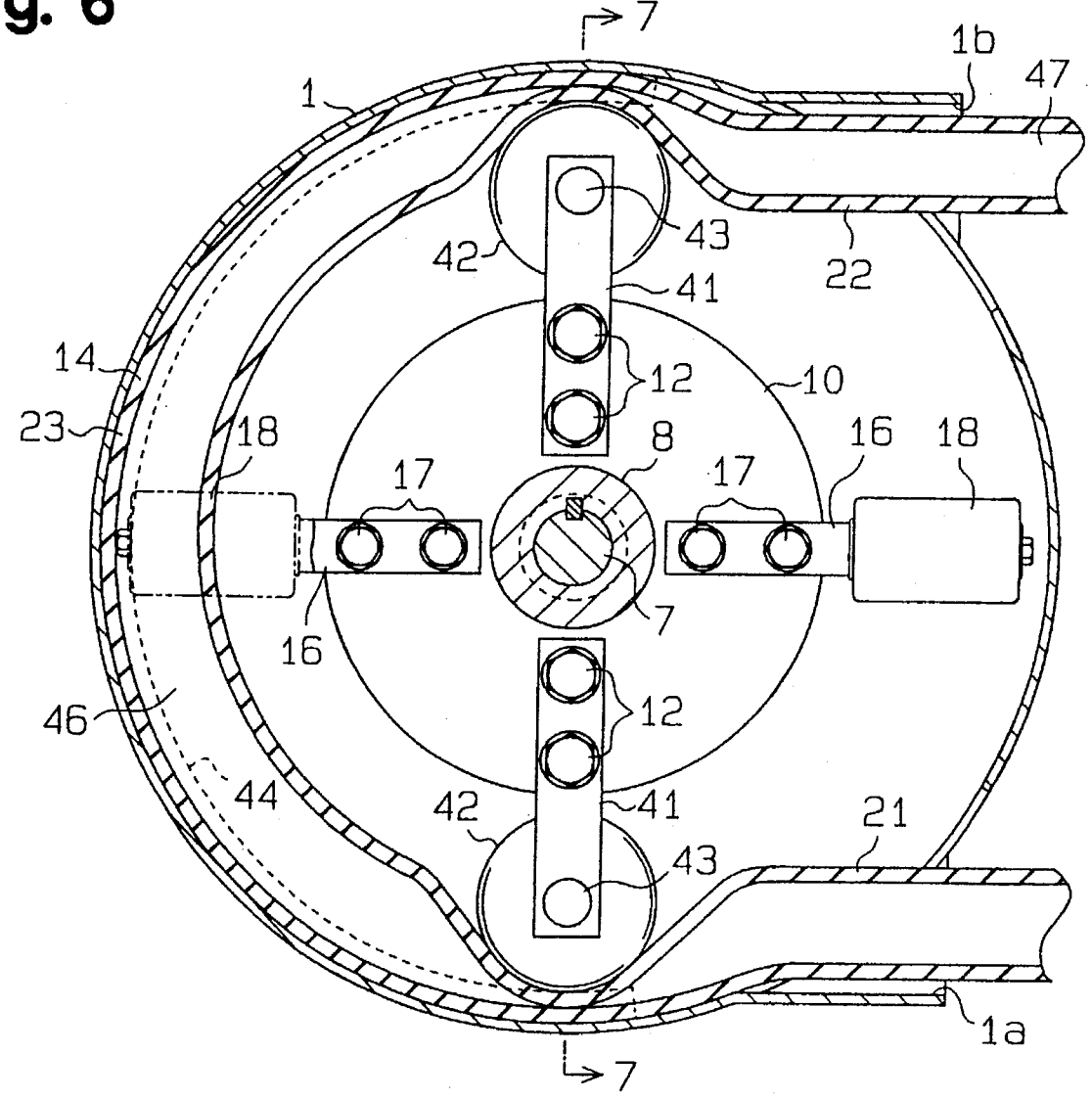
FIG. 6 is a cross-sectional side elevation view of a squeeze type pump showing a second embodiment of the present invention.
Figure 7:
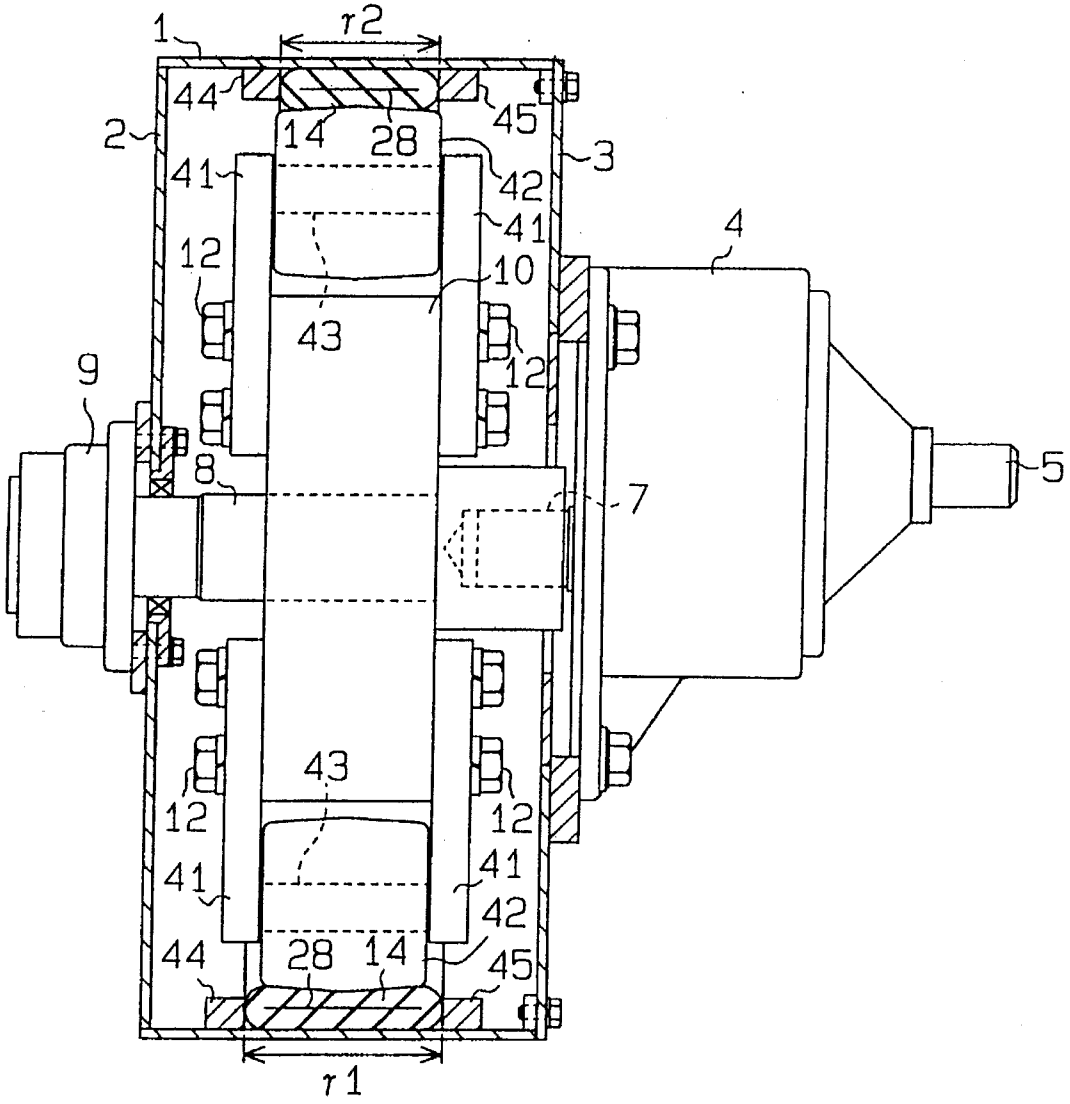
FIG. 7 is a cross-sectional view taken along the line 7—7 in FIG. 6.
Figure 8:
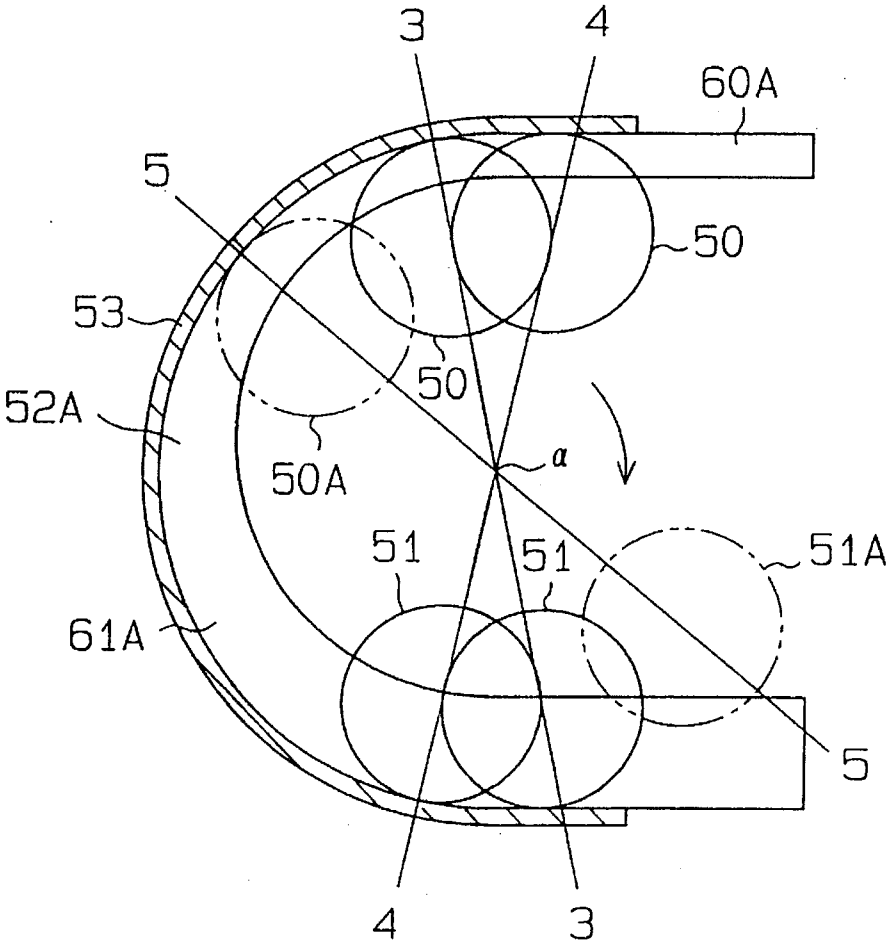
Fig. 8 (Prior Art)
FIG. 8 is a diagrammatic cross-sectional view of a conventional squeeze type pump.
Figure 9:
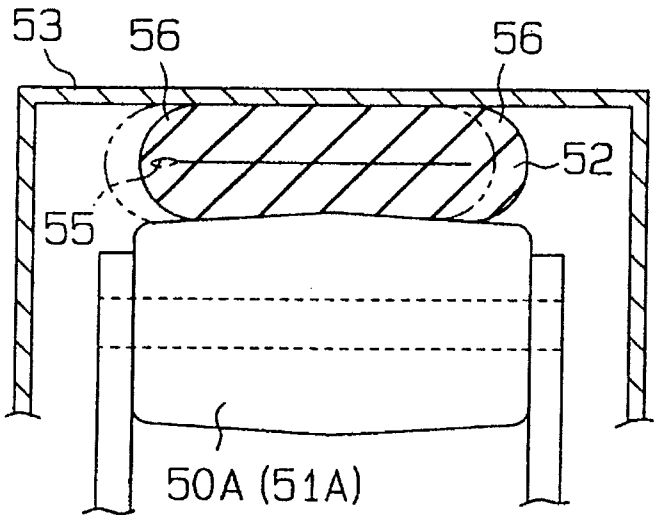
Fig. 9 (Prior Art)
FIG. 9 is a partial cross-sectional front elevation view of a conventional squeeze type pump.
Figure 10:
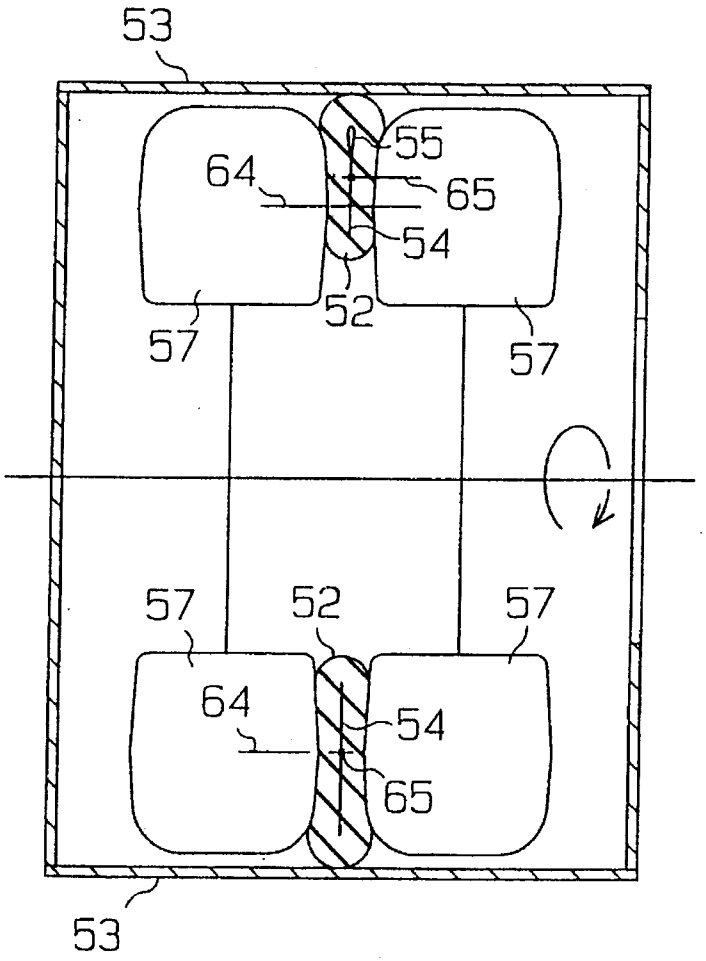
Fig. 10 (Prior Art)
FIG. 10 is a diagrammatic cross-sectional view of a conventional squeeze type pump.
Figure 11:
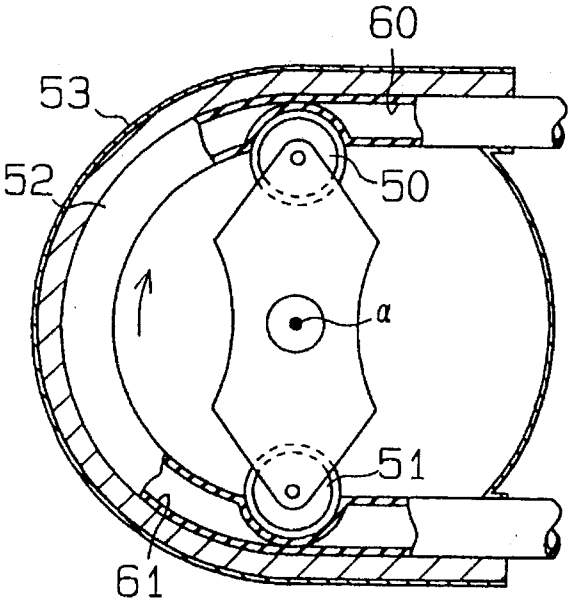
Fig. 11 (Prior Art)
FIG. 11 is a cross-sectional side elevation view of a conventional squeeze type pump.
Figure 12:
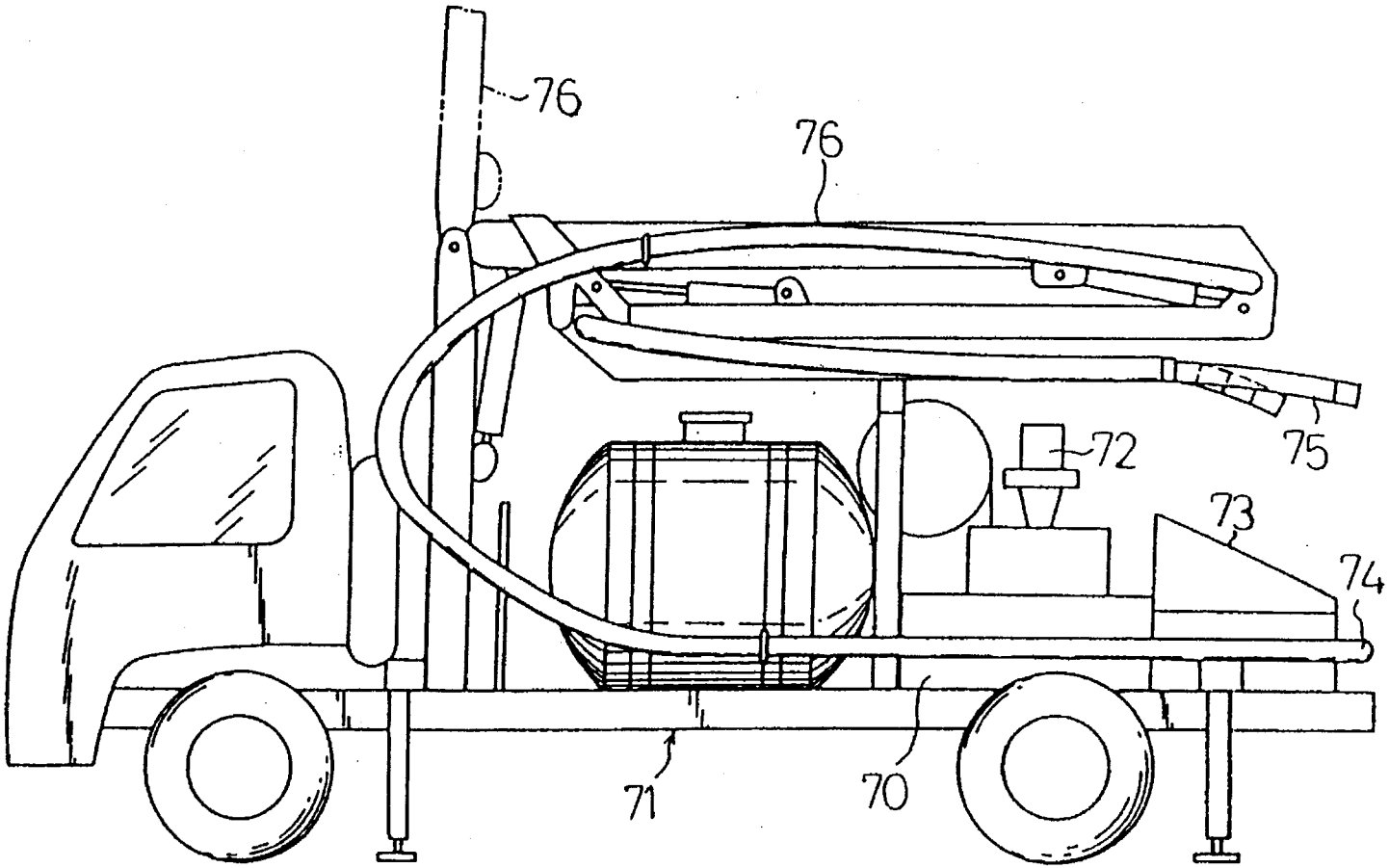
Fig. 12 (Prior Art)
FIG. 12 is a front view showing a vehicle supporting a squeeze type pump.

In this second embodiment, two pairs of supporting arms 41 are fixed to a rotational block 10 by means of bolts 12, as shown in FIGS. 6 and 7. The arms 41 of each pair are so disposed on either side of the block 10. Between the free ends of both arms 41, a pressing roller 42 having the same construction as the above-described tapered roller 13 is rotatably supported by a supporting pin 43. The axis of each roller 42 extends in parallel relationship with the axis of a rotary shaft 8. Unlike the first embodiment, an elastic tube 14 is deformed into a flat shape between the inner circumferential surface of a drum 1 and the outer circumferential surface of the roller 42.

A pair of semi-circular annular protrusions or support members 44 and 45 are fixed to the inner circumferential surface of the drum 1 by welding or the like. Both support member 44 and 45 hold the opposite sides of the tube 14 to prevent the tube 14 from being displaced right and left as seen in FIG. 7. As shown in FIG. 7, the space γ1 between the support members 44 and 45 at the squeeze starting position is made larger than the space γ2 between the support members 44 and 45 at the squeeze completing position.

In this second embodiment, the holding roller 18, in addition to holding the tube in position, also has the function of assisting in restoring the tube 14 to its original cylindrical shape.

Incidentally, according to the second embodiment, the flattened tube 14 is held by the spaced protrusions 44 and 45 so as not to be dislocated laterally. The central portion of the tube 14 in the flat state is therefore pressed at all times by the larger diameter portion, i.e., the central portion of the roller 42. Therefore, no gap is formed in the pressed portion 28 of the tube 14 before the squeeze operation is completed. As a result, a back flow of the slurry in the tube 14 and wear on the inner circumferential surface of the tube resulting from the back flow can be prevented.

The opposite curved sides of the tube 14 are pressed at all times by the tapered portions of the roller 42. For this reason, a reduced pressing force acts on the curved portions of the tube 14. The fatigue on the curved portion is reduced and therefore the durability of the tube 14 is improved.

Although only two embodiments of the present invention have been described herein, it should be apparent to those skilled in the art that the present invention may be embodied in many other specific forms without departing from the spirit or scope of the invention. Particularly, it should be understood that following modes are to be applied.

(1) In the above embodiments, while the elastic tube 14 is formed into a taper shape and the cross-sectional area of the passageway is so constructed as to change continuously, the shape of the tube is not so limited and a tube whose cross-sectional area changes stepwise can also be employed.

(2) In the first embodiment, although the height of the support member 15 is lower in the squeeze starting side than in the squeeze completing side, the invention is not so limited. For example, the height of the support member 15 may be zero at the squeeze starting position, and the inner circumferential surface of the drum 1 may function as the holding surface 32.

(3) Further, the tapered portion of the pressing roller 13 or 42 may be formed so as to extend straight or accurately toward the opposite end portions.

Therefore, the present examples and embodiments are to be considered as illustrative and not restrictive and the invention is not to be limited to the details given herein, but may be modified within the scope of the appended claims.

What is claimed is:

1. A squeeze pump having an elastic tube which is disposed between an inlet and an outlet of a cylindrical drum and extends along an inner peripheral surface of the drum, and a plurality of pressing rollers spaced by a predetermined angle and rotatable about an axis of said drum, said pressing rollers being arranged to press the tube, whereby said tube is deformed into a flat shape with two bent portions to transfer a slurry within the tube, said squeeze pump comprising:

said tube including a large diameter passageway disposed in said inlet, a small diameter passageway disposed in said outlet and a tapered passageway continuously extending from said large diameter passageway to said small diameter passageway, wherein said passageways have a common center;

each of said pressing rollers have a roller axis extending along the entire length of the pressing roller, said pressing roller further including a large diameter portion formed at the middle of the roller axis, two small diameter portions respectively formed at ends of the roller axis and two tapered portions respectively extending from the large diameter portion to the small diameter portions, said pressing rollers being disposed in pairs, wherein each of said pairs comprises opposing pressing rollers with said tube positioned therebetween;

said large diameter portion of said pressing rollers being arranged to move along a first predetermined path to press the common center of the passageways;

each of said small diameter portions of said pressing rollers being arranged to move along a second predetermined path to press the associated bent portion; and a support member disposed between the inner peripheral surface of the drum and the tube and extending along the tube, for supporting at least one of the bent portions of the tube when the tube is pressed by the pressing roller, said support member having a high portion provided adjacent to the outlet, a low portion provided adjacent to the inlet and a middle portion continuously extending from the high portion to the low portion.

2. The squeeze pump as set forth in claim 1, wherein said pairs of pressing rollers are spaced 180 degrees apart.

3. The squeeze pump as set forth in claim 1, further including a rotational block disposed in the drum, said rotational block carrying the pressing rollers and rotatable about the center of the drum.

4. The squeeze pump as set forth in claim 3, further comprising at least a pair of holding rollers disposed between the pressing rollers, wherein said holding rollers are arranged opposite to each other with respect to the tube to hold the tube in a predetermined position.

5. The squeeze pump as set forth in claim 3 further comprising at least a pair of restoration rollers, each of said restoration rollers being arranged to rotate around an axis perpendicular to the roller axis of the pressing roller.

6. The squeeze pump as set forth in claim 1, wherein a ratio of the cross sectional area of the small diameter passageway to the cross sectional area of the large sectional area of the large diameter passage is between about 30 to 40%.

7. The squeeze pump as set forth in claim 1, wherein each of said pressing rollers is disposed opposite to the inner peripheral surface of the drum.

8. A squeeze pump having a cylindrical drum, an elastic tube fed into the drum through an inlet and pulled out from the drum through an outlet, said tube extending along an inner peripheral surface of the drum, and a plurality of pressing rollers spaced by a predetermined angle and rotatable about an axis of said drum, said pressing rollers being arranged to press the tube, whereby said tube is deformed into a flat shape with two bent portions to transfer a slurry within the tube, said squeeze pump comprising:

said tube including a large diameter passageway disposed in said inlet, a small diameter passageway disposed in said outlet and a tapered passageway continuously extending from said large diameter passageway to said small diameter passageway, wherein said passageways have a common center;

said pressing rollers disposed in pairs, said pairs comprising opposing pressing rollers with said tube positioned therebetween, each of said pressing rollers having a roller axis extending along the entire length of the pressing roller, said pressing roller further including a large diameter portion formed at the middle of the roller axis, two small diameter portions respectively formed at ends of the roller axis and two tapered portions respectively extending from the large diameter portion to the small diameter portions;

a support member, extending along the inner peripheral surface of the drum, for supporting at least one of the bent portions of the tube when tube is pressed by the pressing roller, said support member comprising a high portion adjacent to the outlet, a low portion adjacent to the inlet and a middle portion extending continuously from the high portion to the low portion; and wherein said large diameter portion of said pressing rollers moves along a first predetermined path to press the common center of the passageways, and each of said small diameter portion of said pressing rollers moves along a second predetermined path to press the associated bent portion.

9. The squeeze pump as set forth in claim 8, wherein said pairs of pressing rollers are spaced 180 degrees apart.

10. The squeeze pump as set forth in claim 8 further including a rotational block disposed in the drum, said rotational block carrying the pressing rollers and rotatable about the center of the drum.

11. The squeeze pump as set forth in claim 10 further comprising at least a pair of holding rollers disposed between the pressing rollers, wherein said holding rollers are arranged opposite to each other with respect to the tube to hold the tube in a predetermined position.

12. The squeeze pump as set forth in claim 10 further comprising at least a pair of restoration rollers, each of said restoration rollers being arranged to rotate around an axis perpendicular to the roller axis of the pressing roller.

13. The squeeze pump as set forth in claim 8, wherein a ratio of the cross sectional area of the small diameter passageway to the cross sectional area of the large sectional area of the large diameter passage is between about 30 to 40%.

14. The squeeze pump as set forth in claim 8, wherein each of said pressing rollers opposes the inner peripheral surface of the drum.

15. The squeeze pump as set forth in claim 8, wherein said support member comprises a pair of opposing ribs for respectively receiving said two bent portions of the tube, said opposing ribs extending along the tube, and wherein said opposing ribs are separated by a wide space in the vicinity of the inlet and a narrow space in the vicinity of the outlet.

* * * * *